US007146898B2

(12) United States Patent
O'Dwyer

(10) Patent No.: US 7,146,898 B2
(45) Date of Patent: Dec. 12, 2006

(54) BELT-FED MACHINE GUN

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 10/522,009

(22) PCT Filed: Nov. 11, 2002

(86) PCT No.: PCT/AU02/01504

§ 371 (c)(1),
(2), (4) Date: Jan. 14, 2005

(87) PCT Pub. No.: WO03/044443

PCT Pub. Date: May 30, 2003

(65) Prior Publication Data

US 2005/0262996 A1 Dec. 1, 2005

(30) Foreign Application Priority Data

Nov. 19, 2001 (AU) ..... PR8953

(51) Int. Cl.
*F41F 1/10* (2006.01)

(52) U.S. Cl. ..... 89/12

(58) Field of Classification Search ..... 89/12
See application file for complete search history.

(56) References Cited

U.S. PATENT DOCUMENTS 2,979,991 A 4/1961 Buschers et al.
3,041,939 A * 7/1962 Dardick ..... 89/126
3,429,220 A 2/1969 Goode
4,452,123 A 6/1984 Holtrop et al.
5,036,611 A 8/1991 Schmid

FOREIGN PATENT DOCUMENTS

FR 2278052 A 2/1976

OTHER PUBLICATIONS

Metal Storm Limited, PCT/AU02/01504, International Search Report, Feb. 20, 2003, 3 pages.
Metal Storm Limited, PCT/AU02/01504, International Preliminary Examination Report, Apr. 29, 2003, 3 pages.

* cited by examiner

*Primary Examiner*—Stephen M. Johnson
(74) *Attorney, Agent, or Firm*—Blakely, Sokoloff, Taylor & Zafman, LLP

(57) ABSTRACT

A belt-fed machine gun (1) for firing a multiplicity of cartridges (6) encased in sleeves (7), which sleeves are linked to form a belt (8). The machine gun includes a plurality of substantially parallel barrels (2) mounted for circumrotation, a plurality of cradles (5) for supporting the cartridges encased in the sleeves, said cradles being mounted for circumrotation with said plurality of substantially parallel barrels (2) wherein a number of the plurality of cradles in an operative condition are aligned coaxially with corresponding barrels, a housing (9) and a breechblock (10). The housing and said cradles (5) in an operative condition engage sleeves (7) encasing cartridges (6) to form chambers with said breechblock, wherein the breechblock includes a guide (11) for engagement with a follower (15) on the cartridges (6) to urge cartridge and sleeve (7) into engagement with a barrel (2). The gun (1) further includes a firing mechanism for initiating a propellant charge (18) in one or more of the cartridges (6) supported by cradles (5) in the operative condition.

34 Claims, 7 Drawing Sheets

BELT-FED MACHINE GUN

CROSS-REFERENCES TO RELATED APPLICATIONS

The present patent application is a national phase application of International Application No. PCT/AU02/001504 filed Nov. 11, 2002, which claims priority from Australian Application No. PR8953/01 filed Nov. 19, 2001.

BACKGROUND OF THE INVENTION

1. Field of the Invention

The invention relates to guns, in particular to guns such as machine guns that are capable of rapid and sustained fire. The present invention also relates to ammunition for guns and to methods for discharging guns.

2. Discussion of the Background Art

Guns, and in particular machine guns, generally include complex mechanisms for loading a cartridge into a firing chamber of the gun. As a result, the rates of fire of conventional machine guns are generally limited, typically up to about 4500 rounds per minute in a fixed multi-barrelled Gattling type gun.

Various ammunition sleeve arrangements have been used in conjunction with Gattling type guns one such example is presented in U.S. Pat. No. 4,452,123 which discloses a rapid fire gun round made with a composite chamber. The chamber is led by rotational motion rather than by reciprocating motion. The round will work in a recoilless gun configuration. An alternate arrangement permits multiple barrels to be arranged with an ammunition chain to form a Gatling gun configuration. A liner can be inserted in the gun barrel to be replaced with wear as appropriate. However the sleeve arrangement is simply loaded into the breach in the conventional manner which does not provided an effective seal between the cartridge and the barrel and as such does not avoid the adverse effects on both the projectile and barrel caused by the lateral spread of pressure and exhaust gases resulting from ignition of the propellant.

Another such example of a machine gun is described in the earlier international patent application PCT/AU00/00857 by the present applicant in which is disclosed a gun including a barrel assembly feed for advancing a plurality of barrel assemblies of the type having a plurality of projectiles stacked axially within each barrel assembly together with discrete selectively ignitable propellant charges for propelling the projectiles from each barrel assembly. The plurality of barrel assemblies are linked together in spaced apart parallel relationship and one or more barrel assemblies are located in a firing station wherein the firing station operatively supports the one or more barrel assemblies. The gun further includes a charge initiator associated with the firing station for selectively initiating said discrete selectively ignitable propellant charges of one or more barrel assemblies operatively supported by the firing station. The barrel assembly has an inner barrel made of a hard, non-deformable material and an outer casing of a ductile material. The outer casing may be deformed by the slots and sprocket teeth of a sprocket drive.

SUMMARY OF THE INVENTION

Object of the Invention

Accordingly, it is an object of the present invention to provide a gun that is capable of an ultra high rate of fire.

It is another object of the present invention to provide a gun that is capable of variable rates of fire, wherein the rate is selectively variable from single shot and low rates of fire through to ultra high rates of fire.

Further objects will be apparent from the following discussion of the invention.

Disclosure of the Invention

Accordingly the present invention provides a belt-fed machine gun for firing a multiplicity of cartridges encased in sleeves and linked to form a belt, said belt-fed machine gun including a plurality of substantially parallel barrels mounted for circumrotation; a plurality of cradles for supporting the cartridges encased in the sleeves, said cradles being mounted for circumrotation with said plurality of substantially parallel barrels wherein a number of the plurality of cradles in an operative position are aligned coaxially with corresponding barrels;

a housing and a breechblock, wherein said housing and said number of cradles in the operative position engage sleeves encasing cartridges to form chambers with said breechblock, and said breechblock further includes a guide to engage with the cartridges or sleeves for urging said cartridges and sleeves towards said corresponding barrels; and a firing mechanism for initiating a propellant charge in one or more of the cartridges supported by cradles in the operative condition.

In another form of the invention the plurality of substantially parallel barrels may include first and second sets of barrels arranged concentrically with respect to one another, said first and second sets of barrels having respective cradles and cooperating breech blocks.

It will be understood that the term "gun" refers to an elongate tube from which projectiles are thrown by the force of an explosive. Such projectiles are often referred to as "rounds". It will also be understood that the term "machine gun" refers to a gun operated by a mechanism capable of delivering rapid and sustained fire of rounds. In the context of this invention the term "machine gun" particularly relates to firearms which are capable of rapid and sustained fire of projectiles. This capability may be controlled either by a firer having manual control over the firing of the firearm or by an automated system such as one controlled by computer.

The plurality of substantially parallel barrels may include any number of barrels. The number of barrels that are preferred will depend on the application and will be discussed hereunder. The plurality of substantially parallel barrels mounted for circumrotation may be mounted on any convenient frame. The barrels are preferably spaced equidistantly and circumrotate about an axis of rotation. Preferably the frame may include two or more spaced apart annular rings. Alternatively, the plurality of substantially parallel barrels mounted for circumrotation may be in the form of bores in a cylinder or tubular section.

The frame on which the plurality of substantially parallel barrels is mounted may be rotatably mounted on the gun such that the barrels, being offset from the axis of rotation of the frame, circumrotate about said axis.

The plurality of cradles mounted for circumrotation with the plurality of substantially parallel barrels may be mounted on any convenient frame. The cradles preferably circumrotate about the same axis as the barrels of the gun and are preferably spaced equidistantly. Preferably the plurality of cradles are formed as channels in the external surface of a cylinder.

It is preferred that each barrel and has a corresponding cradle with which it is coaxially aligned and the barrels and cradles circumrotate in unison. Other configurations may be feasible but for simplicity of operation, as well as for reasons of safety and reliability of operation, it is preferred that each barrel has a corresponding cradle with which it circumrotates in unison.

In the operative condition, a number of the barrels and cradles are aligned and circumrotate in unison allowing a cartridge loaded in the cradle to be discharged and a round fired down the barrel. In the preferred configuration, the barrels and cradles are circumrotated in unison and maintained in alignment. It falls within the scope of this invention that other configurations of barrels, cradles and associated operating mechanisms may be employed as desired.

The housing and the breech block may be formed from separate parts, although it is preferred that the housing and breech block are formed integrally as a single member that cooperates with the cradles in an operative condition to form the chambers.

The housing, breechblock and cradles in the operative condition engage the sleeves encasing the cartridges to form chambers. The cradles may preferably be shaped to conform to the outer profile of the sleeves. In the preferred configuration, the cross-section of the cradle is substantially semi-circular with a flared opening to allow sleeves having a corresponding cross-section to be received in and supported by the cradle. The inner wall of the housing may be shaped to tightly engage the sleeves and provide a sealed chamber as the sleeves circumrotate in the cradle with the barrels. In a preferred configuration the housing may be shaped to tightly engage the sleeves and provide a sealed chamber at firing stations about the and to minimise friction between the sleeves and the housing as the sleeves in the remainder of the circumrotation. Such a configuration may be in the form of a cam urging the sleeves laterally into the cradles at the firing stations whilst the remainder of the housing engages the sleeves with lessor force and minimises friction between the sleeves and the housing over which the sleeves are dragged.

The breechblock closes the breech end of the chamber and the breechblock is preferably formed integrally with the housing. The breechblock preferably includes a guide for engaging with the cartridge or the sleeve such that the cartridge or sleeve travels along a desired path when not constrained by the chamber. The breechblock also preferably includes a cam for urging the cartridge into sealable engagement with the barrel for firing of the cartridge. A suitable sleeve configuration for use with a cam in the breechblock includes a frustro-conical nose that engages a corresponding taper in the adjacent end of the barrel such that a seal is produced which alleviates the effects of the lateral spread of pressure and the exhaust gases produce from the ignition of the propellent.

The first sleeve encasing a cartridge of a belt is preferably fed into the cradles from below the cradles at, for example, a position corresponding to 8 o'clock. As the cradle rotates, subsequent sleeves engage subsequent cradles at that position. The housing may be configured to engage with the sleeves at about the 9 o'clock position. The cradles circumrotate to a first firing position where the cartridge in the cradle may be discharged. Additional firing positions may be provided at positions spaced around the path circumscribed by the cradles. In a gun having eight equally spaced cradles, up to five firing positions may be conveniently provided for discharging the cartridges.

The housing and cradles in an operative condition, such as in a firing position as described above, engage sleeves encasing cartridges to form chambers with said breechblock. In a preferred embodiment, chambers are formed by the housing engaging the sleeves and the linkages therebetween. The sleeves and the linkages therebetween may seal the chamber such that it is capable of discharging the cartridge.

The firing mechanism for initiating a propellant charge in one or more of the cartridges may be by any convenient initiation means. In applications requiring ultra-high rates of fire, it is preferred that the cartridges are discharged by an electrical initiation. In applications requiring only low rates of fire, mechanical initiation of the cartridge may be convenient.

The barrels and cradles may be rotated by any convenient means. It is preferred that the rotation is provided by an electric motor which may directly engage the barrels and cradles or may engage the barrels and cradles through gears selected to provide the desired speed of rotation and torque. The drive mechanism may be capable of variable speed such that the rate of fire of the gun may be varied in use.

In a first preferred embodiment of the present invention the gun may be used to fire cartridges of conventional form, that is cartridges having a bullet, a propellent and a detonator enclosed in a casing that is typically brass. Such cartridges are typically employed in small arms. In this embodiment, the cartridge is generally provided with one or more tapers towards the bullet and the sleeve may be provided with an internal bore corresponding to the taper or tapers of the cartridge. The sleeve may extend partially or full the length of the cartridge. The sleeve may also partially or fully encase the cartridge.

In this first embodiment the gun may achieve ultra high rate of fire. The rate of fire will be dependent, amongst other factor, on the speed of rotation and rate of loss of gas pressure in the chamber. For example, with eight barrels circumrotating at 4000 rpm and each barrel firing once per rotation a rate of fire of 32000 rounds per minute may be achieved.

The cartridge may extend beyond the rear of the sleeve and engage a guide having lateral recesses for engagement with the flanges on rear of the cartridge. The guide may provide the cam for urging the sleeve and the cartridge towards the barrel in the operative condition.

Such ultra-high rates of fire increase the operating temperature of the chambers and the barrels and cooling of the chambers and barrels may be desirable. Overheating of the chambers can result in cook-off of the gun, wherein a cartridge becomes jammed in the chamber and is unable to be fired. The applicants have found that by providing a sleeve having good thermal insulating properties the likelihood of cook-off is reduced. An alternate approach to minimising cook-off is to have the sleeve as a heat sink, with the belt acting as a thermal insulation so that the heat is removed from the chamber with the sleeve and the cartridge. As a result of the use of multiple chambers the heat build-up in any one chamber is significantly less than the heat build-up than in machine guns employing a single chamber.

The barrels may also be susceptible to overheating and it may be desirable to not discharge a cartridge down each barrel each rotation. For example, by providing an odd number of barrels and spacing the sleeves to be supported in every second cradle a lower rate fire would be achieved whilst each of the barrels would be utilised equally. A similar arrangement may be provided in an eight barrelled configuration where the sleeves are spaced to be engaged by every third cradle. Other barrel configurations will be apparent to the skilled artisan.

In a preferred embodiment the cartridges may be provided with a coolant for subsequent release after the bullet has been fired. At the first firing station the propellant is detonated and the bullet fired and at a second firing station a second initiation may release a coolant, such as a compressed gas, contained within the cartridge. The coolant, as it expands and is released down the barrel, will cool the barrel.

In a second preferred embodiment, the cartridge may be of the type described in International Patent Application Nos. PCT/AU94/00124 and PCT/AU96/00459. Such cartridges include a shell; a plurality of projectiles axially disposed within the shell for operative sealing engagement with the bore of the tubular shell, and discrete propellant charges for propelling respective projectiles.

These cartridges may be provided with an additional sleeve or may formed with the shell as the sleeve. The projectile may be round, conventionally shaped or dart-like and the fins thereof may be offset to generate a stabilising spin as the dart is propelled from a barrel that may be a smooth-bored barrel.

The projectile charge may be form as a solid block to operatively space the projectiles in the shell or the propellant charge may be encased in metal or other rigid case, which may include an embedded primer having external contact means adapted for contacting an pre-positioned electrical contact associated with the shell. For example the primer could be provided with a sprung contact which may be retracted to enable insertion of the cased charge into the shell and to spring out into an aperture upon alignment with that aperture for operative contact with its mating shell contact. If desired the shell may be consumable or may chemically assist the propellant burn.

Each projectile may include a projectile head and extension means for at least partly defining a propellant space. The extension means may include a spacer assembly that extends rearwardly from the projectile head and abuts an adjacent projectile assembly. The spacer assembly may extend through the propellant space and the projectile head whereby compressive loads are transmitted directly through abutting adjacent spacer assemblies. In such configurations, the spacer assembly may add support to the extension means that may be a thin cylindrical rear portion of the projectile head. Furthermore the extension means may form an operative sealing contact with the bore of the shell to prevent burn leakage past the projectile head.

The spacer assembly may include a rigid collar which extends outwardly to engage a thin cylindrical rear portion of the malleable projectile head in operative sealing contact with the bore of the shell such that axially compressive loads are transmitted directly between spacer assemblies thereby avoiding deformation of the malleable projectile head. Complementary wedging surfaces may be disposed on the spacer assembly and projectile head, respectively, whereby the projectile head is urged into engagement with the bore of the shell in response to relative axial compression between the spacer means and the projectile head. In such arrangement the projectile head and spacer assembly may be loaded into the barrel and there after an axial displacement is caused to ensure good sealing between the projectile head and barrel. Suitably the extension means is urged into engagement with the bore of the barrel.

The projectile head may define a tapered aperture at its rearward end into which is received a complementary tapered spigot disposed on the leading end of the spacer assembly, wherein relative axial movement between the projectile head and the complementary tapered spigot causes a radially expanding force to be applied to the projectile head.

The shell may be non-metallic and the bore of the shell may include recesses which may fully or partly accommodate the ignition means. In this configuration the shell houses electrical conductors which facilitate electrical communication between the control means and ignition means. This configuration may be utilised for disposable shell assemblies which have a limited firing life and the ignition means and control wire or wires therefor can be integrally manufactured with the shell.

A cartridge may alternatively include ignition apertures in the shell and the ignition means are disposed outside the shell and adjacent the apertures. The shell may be surrounded by a non-metallic outer shell which may form the sleeve which may include recesses adapted to accommodate the ignition means. The outer shell may also house electrical conductors which facilitate electrical communication between the control means and ignition means. The outer shell may be formed as a laminated plastics shell which may include a printed circuit laminate for the ignition means.

The cartridge may have adjacent projectiles that are separated from one another and maintained in spaced apart relationship by locating means separate from the projectiles, and each projectile may include an expandable sealing means for forming an operative seal with the bore of the shell. The locating means may be the propellant charge between adjacent projectiles and the sealing means suitably includes a skirt portion on each projectile which expands outwardly when subject to an in-shell load. The in-shell load may be applied during installation of the projectiles or after loading such as by tamping to consolidate the column of projectiles and propellant charges or may result from the firing of an outer projectile and particularly the adjacent outer projectile.

The rear end of the projectile may include a skirt about an inwardly reducing recess such as a conical recess or a part-spherical recess or the like into which the propellant charge portion extends and about which rearward movement of the projectile will result in radial expansion of the projectile skirt. This rearward movement may occur by way of compression resulting from a rearward wedging movement of the projectile along the leading portion of the propellant charge it may occur as a result of metal flow from the relatively massive leading part of the projectile to its less massive skirt portion.

Alternatively the projectile may be provided with a rearwardly divergent peripheral sealing flange or collar which is deflected outwardly into sealing engagement with the bore upon rearward movement of the projectile. Furthermore the sealing may be effected by inserting the projectiles into a heated shell which shrinks onto respective sealing portions of the projectiles. The projectile may comprise a relatively hard mandrel portion located by the propellant charge and which cooperates with a deformable annular portion may be moulded about the mandrel to form a unitary projectile. The unitary projectile relies on metal flow between the nose of the projectile and its tail for outward expansion about the mandrel portion into sealing engagement with the bore of the shell.

The projectile assembly may include a rearwardly expanding anvil surface supporting a sealing collar thereabout and adapted to be radially expanded into sealing engagement with the shell bore upon forward movement of the projectile through the shell. In such a configuration, it is preferred that the propellant charge have a cylindrical leading portion which abuts the flat end face of the projectile.

The projectiles may be adapted for seating and/or location within circumferential grooves or by annular ribs in the bore or in rifling grooves in the bore and may include a metal jacket encasing at least the outer end portion of the projectile. The projectile may be provided with contractible peripheral locating rings which extend outwardly into annular grooves in the shell and which retract into the projectile upon firing to permit its free passage through the barrel.

An electrical ignition sequence for sequentially igniting the propellant charges of a barrel assembly may preferably include the steps of igniting the leading propellant charge by sending an ignition signal through the stacked projectiles, and causing ignition of the leading propellant charge to arm the next propellant charge for actuation by the next ignition signal. Suitably all propellant charges inwardly from the end of a loaded shell are disarmed by the insertion of respective insulating ruses disposed between normally closed electrical contacts.

Ignition of the propellant may be achieved electrically or ignition may utilise conventional firing pin type methods such as by using a centre-fire primer igniting the outermost projectile and controlled consequent ignition causing sequential ignition of the propellant charge of subsequent rounds. This may be achieved by controlled rearward leakage of combustion gases or controlled burning of fuse columns extending through the projectiles.

In another form the ignition is electronically controlled with respective propellant charges being associated with primers which are triggered by distinctive ignition signals. For example the primers in the stacked propellant charges may be sequenced for increasing pulse width ignition requirements whereby electronic controls may selectively send ignition pulses of increasing pulse widths to ignite the propellant charges sequentially in a selected time order. Preferably however the propellant charges are ignited by a set pulse width signal and burning of the leading propellant charge arms the next propellant charge for actuation by the next emitted pulse.

Suitably in such embodiments all propellant charges inwardly from the end of a loaded barrel are disarmed by the insertion of respective insulating fuses disposed between insertion of respective insulating fuses disposed between normally closed electrical contacts, the fuses being set to burn to enable the contacts to close upon transmission of a suitable triggering signal and each insulating fuse being open to a respective leading propellant charge for ignition thereby.

A number of projectiles can be fired simultaneously, in quick succession, or in response to repetitive manual actuation, of a trigger for example. In such arrangements the electrical signal may be carried externally of the barrel or it may be carried through the superimposed projectiles which may clip on to one another to continue the electrical circuit through the barrel, or abut in electrical contact with one another. The projectiles may carry the control circuit or they may form a circuit with the barrel.

In certain applications it may be preferable for the axially disposed projectiles to be independently selected from a number of projectile types. For example in an application whereby a target is to be pierced and then destroyed the first projectile may be armour piercing (kinetic) and the subsequent projectiles may contain high explosive for destroying the target. The second or subsequent projectiles may be adapted to penetrate the target and detonate behind the wall of the target.

In a third embodiment the present invention may employed in high calibre applications, such as in fixed guns of the type mounted on naval vessels. Whilst the size of the cartridges will preclude ultra-high rates of fire the rates achievable will still exceed those achievable in conventional weapons systems. For example 5½" cartridges may be loaded into a belt of sleeves and the gun of the present invention used to sustained fire these shells. Cartridges of the type described in International Patent Application Nos. PCT/AU94/00124 and PCT/AU96/00459 may be used in this third embodiment.

It is preferred that the first projectile is selected for hitting the target and that subsequent projectiles are dummies, such that the detonation of the propellant behind the dummy whilst the first projectile is still in the barrel provides an additional impulse to the first projectile imparting additional kinetic energy to same.

The guns of the present invention may include a first and second sets of barrels arranged concentrically with respect to one another. The inner first set of barrels and outer second set of barrels may circumrotate independently or be rotated in unison. The outer plurality of barrels has a corresponding plurality of cradles for receiving a further belt of sleeves encasing cartridges. The inner and outer guns may be configured for firing different cartridges and provide a gun capable of delivering a variety of responses without the need for multiple weapons or reloading. Advantageously, the use of concentric sets of barrels allows the speed of circumrotation of both sets of barrels to be reduced whilst maintaining the rate of fire available from a single set of barrels. In many applications, rates of fire in excess of a particular value do not contribute to the effectiveness of the gun.

BRIEF DETAILS OF THE DRAWINGS

In order that this invention may be more readily understood and put into practical effect, reference will now be made to the accompanying drawings which illustrate preferred embodiments of the invention and wherein.

DESCRIPTION OF EMBODIMENTS OF THE INVENTION

Figure 1:
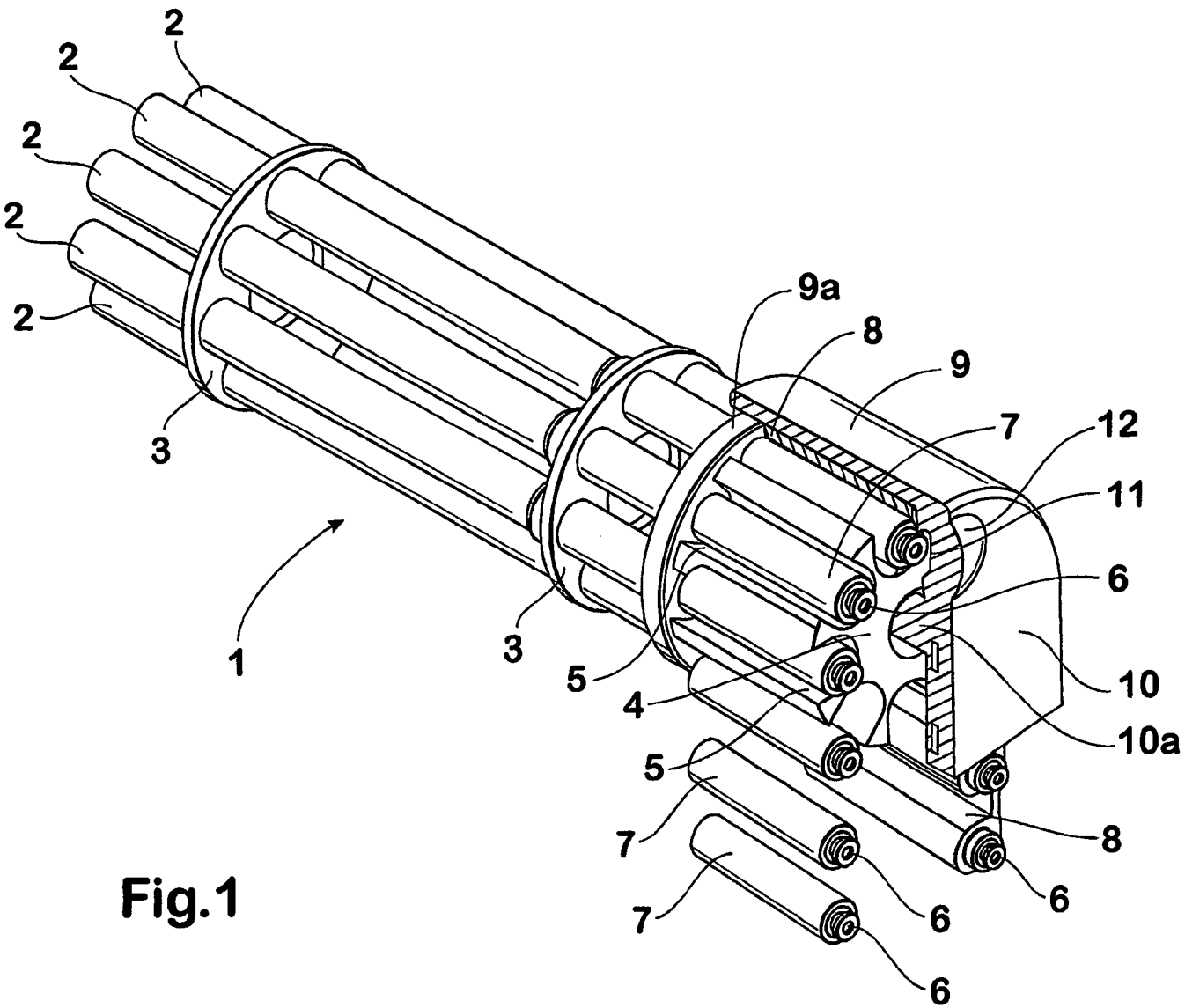
FIG. 1 is an isometric representation of an embodiment the gun of the present invention with part of a gun housing, breech block and feed belt cut away.

FIG. 1 shows a machine gun 1 of a preferred embodiment having eight barrels 2, supported by two annular rings 3, which barrels are arranged for circumrotation about a longitudinal axis of the gun. The gun 1 has a cylinder 4 having eight longitudinally extending troughs aligned with the barrels 2 for circumrotation on an axial support member 10*a*. The axial support member 10*a* is integrally formed with a breech block 10 in the embodiment. Inner faces of respective troughs provide cradles 5 that support cartridges 6. The cartridges 6 are disposed in sleeves 7 and the sleeves are retained in a feed belt 8. The belt 8 engages the cradles 5 and the housing 9 to form a chamber. The rear of the chamber is defined by the breechblock 10. The breechblock 10 has a guide 11 for holding the cartridges 6 and urging the cartridges and the sleeves towards the barrel 2 in an operative position 12.

Figure 2:
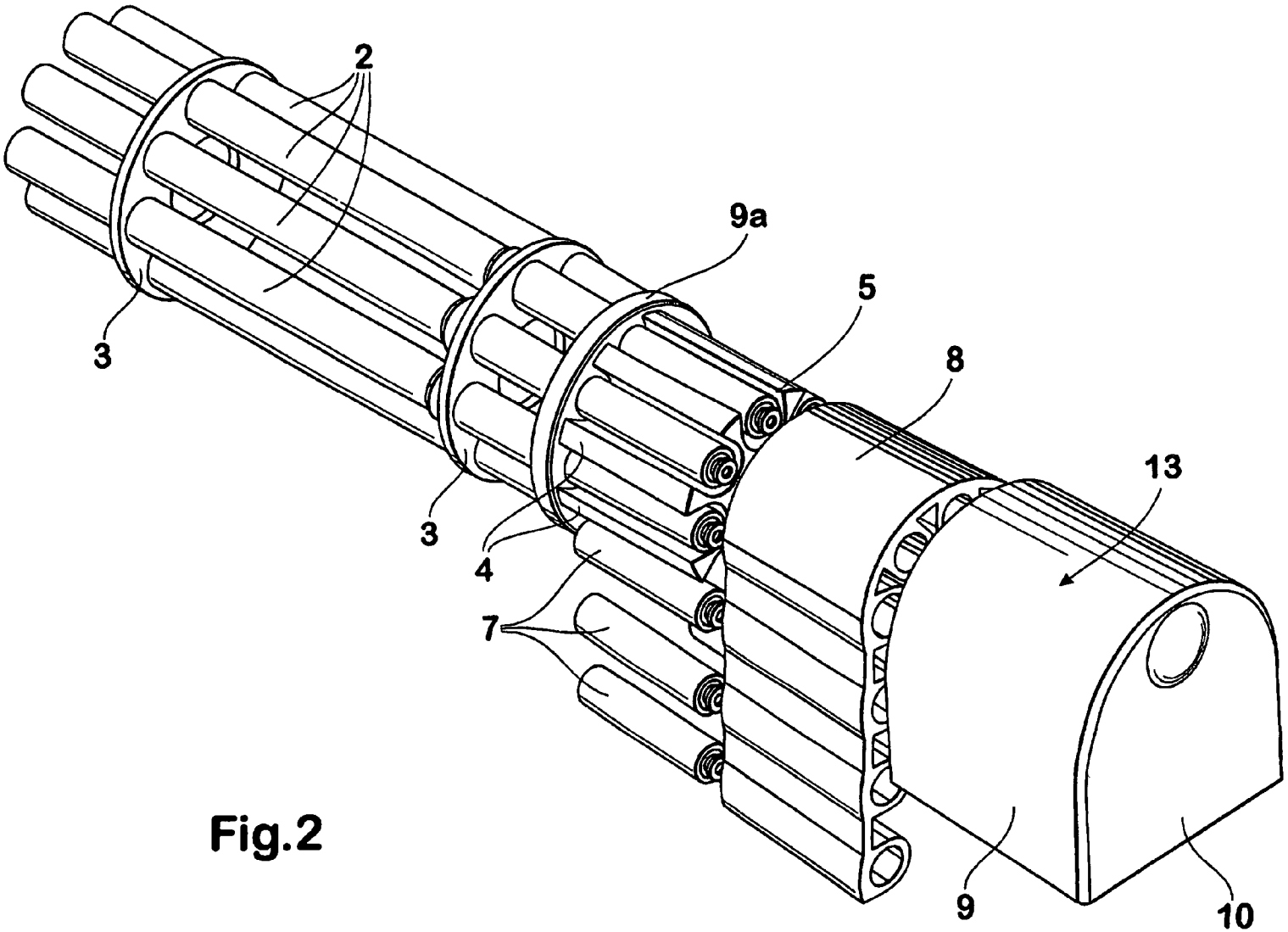
FIG. 2 is an exploded isometric view of the gun of FIG. 1.

FIG. 2, which is an exploded view of the assembled machine gun 1 of FIG. 1, shows how the belt 8 extends around the cylinder 4 when assembled. The housing 9 and the breechblock 10 can be seen to be formed as an integral casing 13 in the embodiment. An apertured plate member 9*a* supporting breech ends of barrels 2 forms the front of the chamber.

Figure 5:
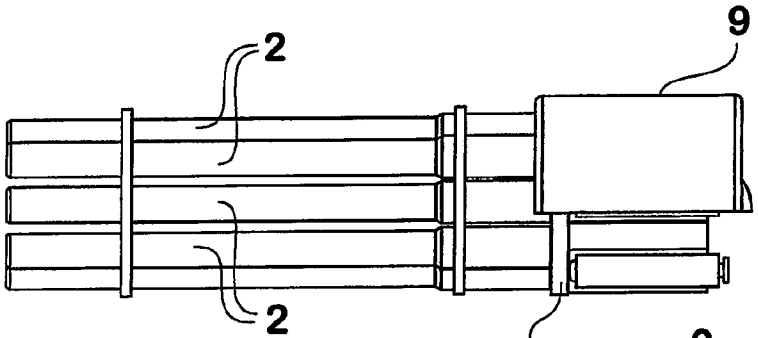
FIG. 5 is a top view of the gun of FIG. 1.
Figure 4:
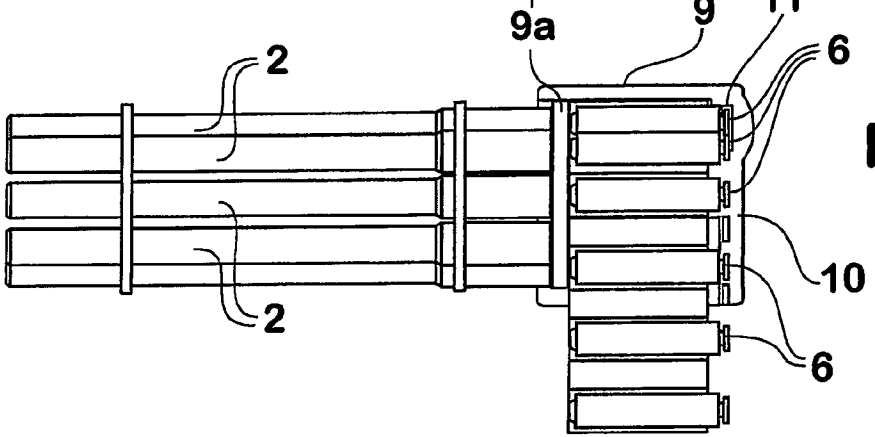
FIG. 4 is a side view of the gun of FIG. 1.
Figure 6:
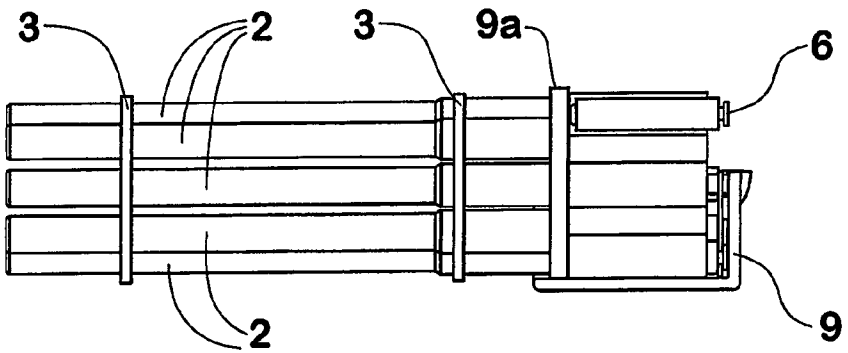
FIG. 6 is a bottom view of the gun of FIG. 1.
Figure 3:
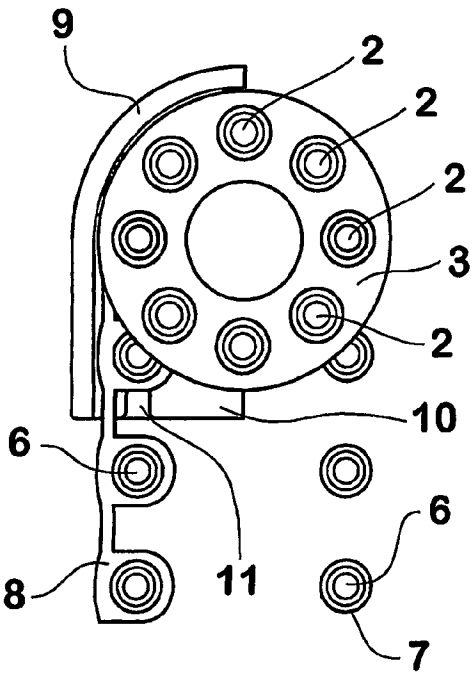
FIG. 3 is a front end view of the gun of FIG. 1.

FIG. 3 is a front view showing the eight barrels 2 and the forward annual support ring 3. On the left hand side of FIG. 3 the housing and the feed belt 8 may be seen. On the right hand side of FIG. 3 the housing 9, breechblock 10 and belt 8 have been cut away as per FIG. 1. FIG. 4 shows the breechblock 10 guiding the cartridges 6 towards the barrels 2. FIGS. 5 and 6 are top and bottom views, respectively, corresponding to FIG. 1.

Figure 7:
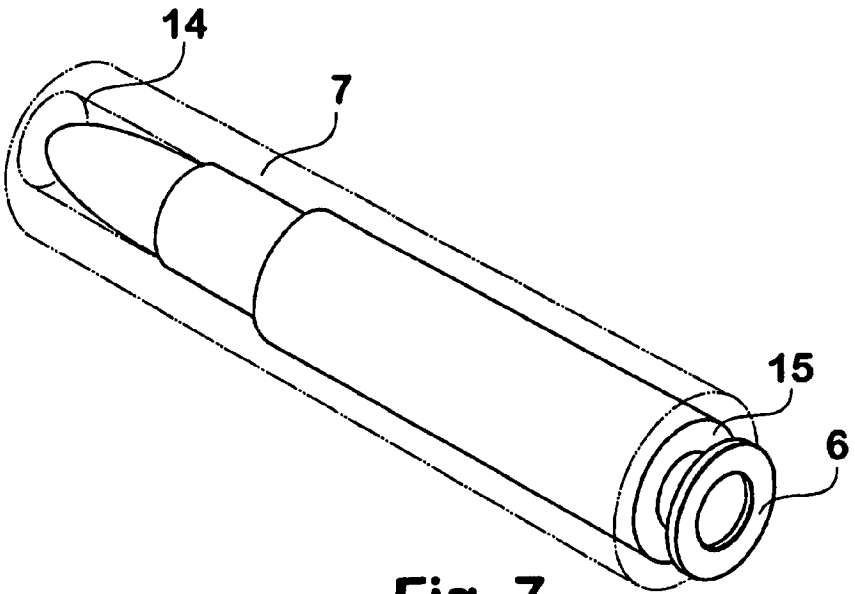
FIG. 7 is an isometric view of a cartridge loaded in a sleeve associated with an embodiment of the invention.

FIG. 7 shows an example of a cartridge 6 in a shell 7. The shell 7 has a frustro-conical leading end 14 for engagement with a barrel 2. The cartridge 6 has a follow up 15 to engage a guide in the breechblock for urging the cartridge 6 and the sleeve 7 into the barrel 2 using a camming type action such that a seal is produced which alleviates the effects of the lateral spread of pressure and the exhaust gases produce from the ignition of the projectiles propellent.

Figure 8:
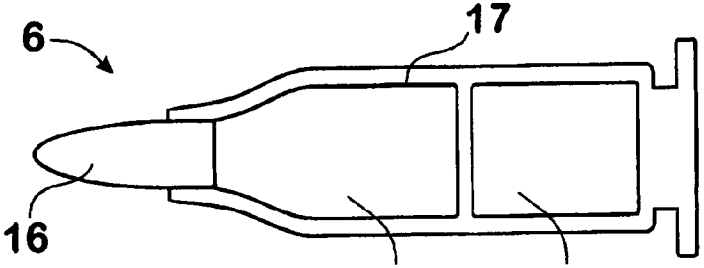
FIG. 8 is a cross section of the cartridge depicted in FIG. 7.

FIG. 8 shows a cartridge 6 having a bullet 16 in a casing 17, the casing having a first cavity 18 for housing a propellant and a second cavity 19 for housing a coolant. The propellant may be ignited to project the bullet down the barrel, and the coolant may subsequently be released to cool the chamber and the barrel.

Figure 9:
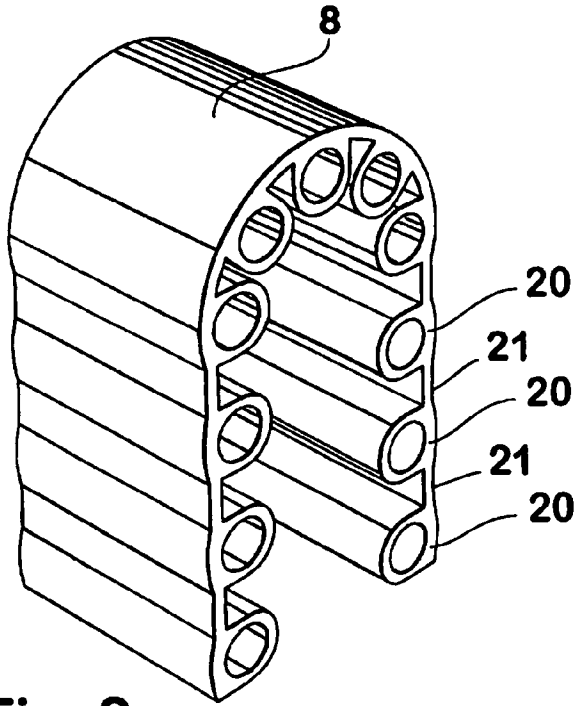
FIG. 9 is a view of a belt for use in the gun of the embodiment.

FIG. 9 shows a feed belt 8 having an outer profile that forms a semi-circular cross section. Between the segments 20 of the belt for receiving the sleeves 7 are concave segments 21 which, act with the segments 20 to form the semi circular cross section.

Figure 10:
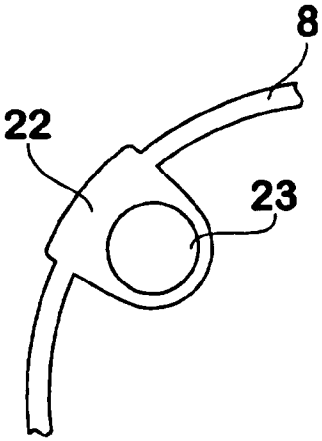
FIG. 10 is a partial cross-section of a belt for use in the gun of the present invention.
Figure 11:
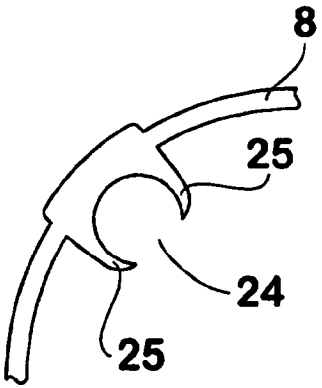
FIG. 11 is a partial cross section of a further belt for use in the gun of the present invention.

FIG. 10 shows a belt 8 that has a proud portion 22 for engagement an interior surface of the housing 9, which portion is adjacent a cavity 23. The outer surface of the belt 8 is adapted to provide minimal contact with the housing, so as to reduce the energy required to drive the belt 8. The cavity 23 is provided for retaining a cartridge 6, with or without a sleeve 7 therein as required. FIG. 11 shows a variant of the belt 8 having an open cavity 24 defined by opposed resilient arcuate portions 25, whereby a cartridge 6 (optionally within a sleeve 7) may be snapped into the belt.

Figure 12:
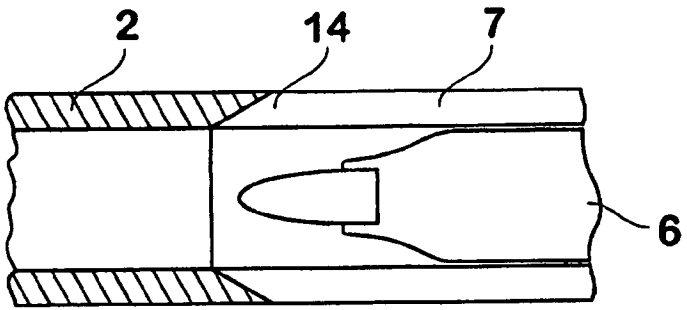
FIG. 12 is a cross section illustrating engagement between the sleeve and the barrel of an embodiment of the present invention.
Figure 13:
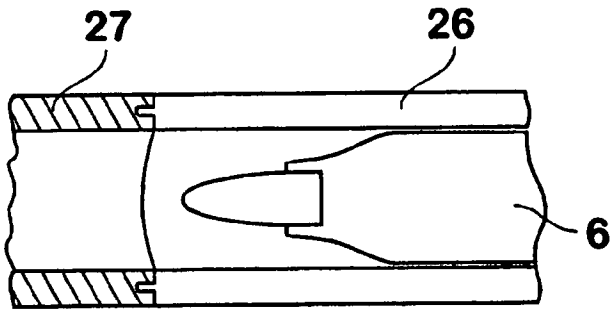
FIG. 13 is a cross section illustrating engagement of the sleeve and the barrel of another embodiment of the present invention.

FIG. 12 shows a cartridge 6 in a sleeve 7 having a frustro-conical leading end 14 which is engaged with a barrel 2 having a correspondingly shaped rear portion. In another form, FIG. 13 shows a cartridge 6 in a sleeve 26 having a tongue in groove male leading end for engagement with a corresponding grooved rear end of a barrel 27.

Figure 14:
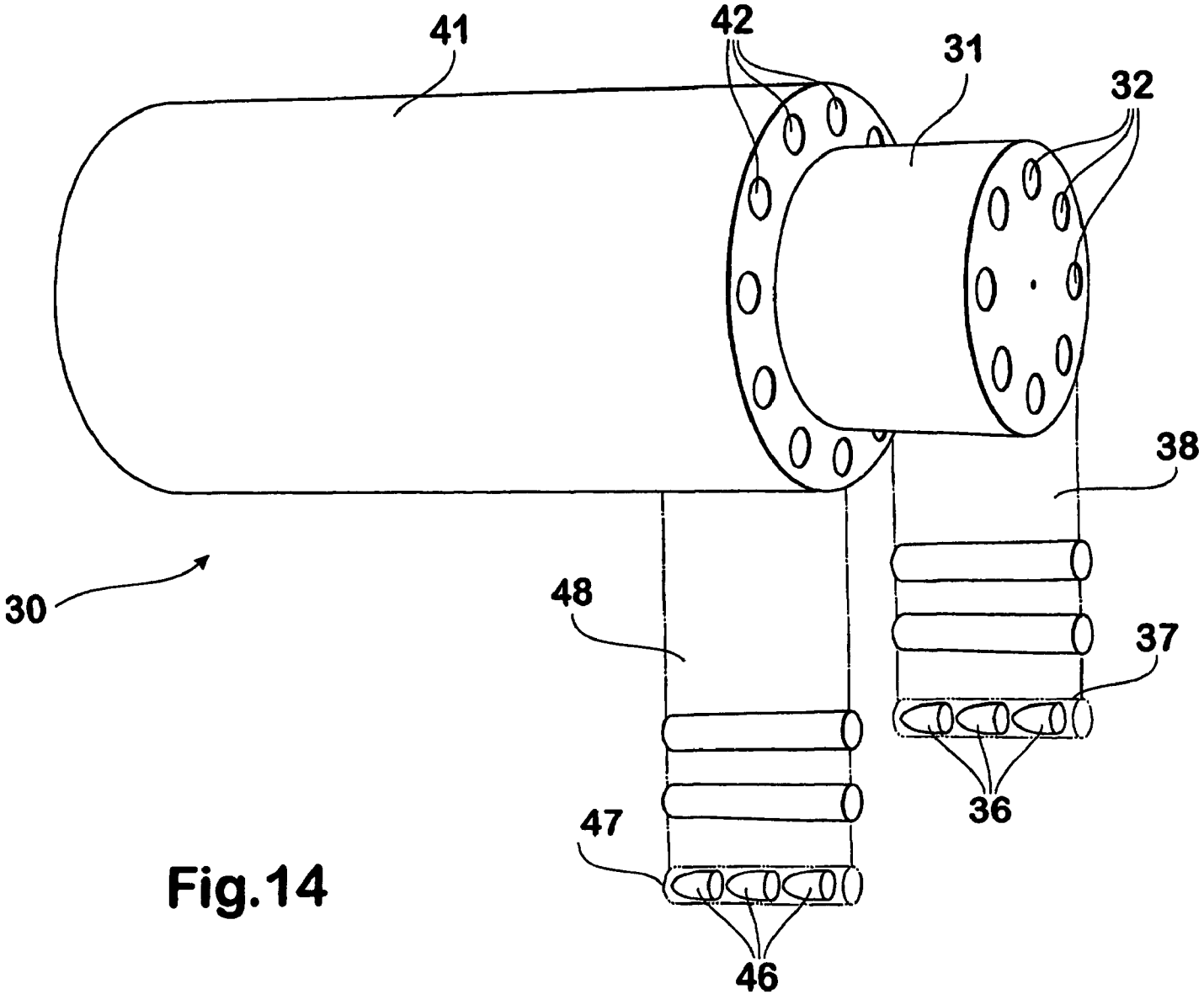
FIG. 14 is a conceptual isometric view of a gun of a further embodiment of the present invention.
Figure 15:
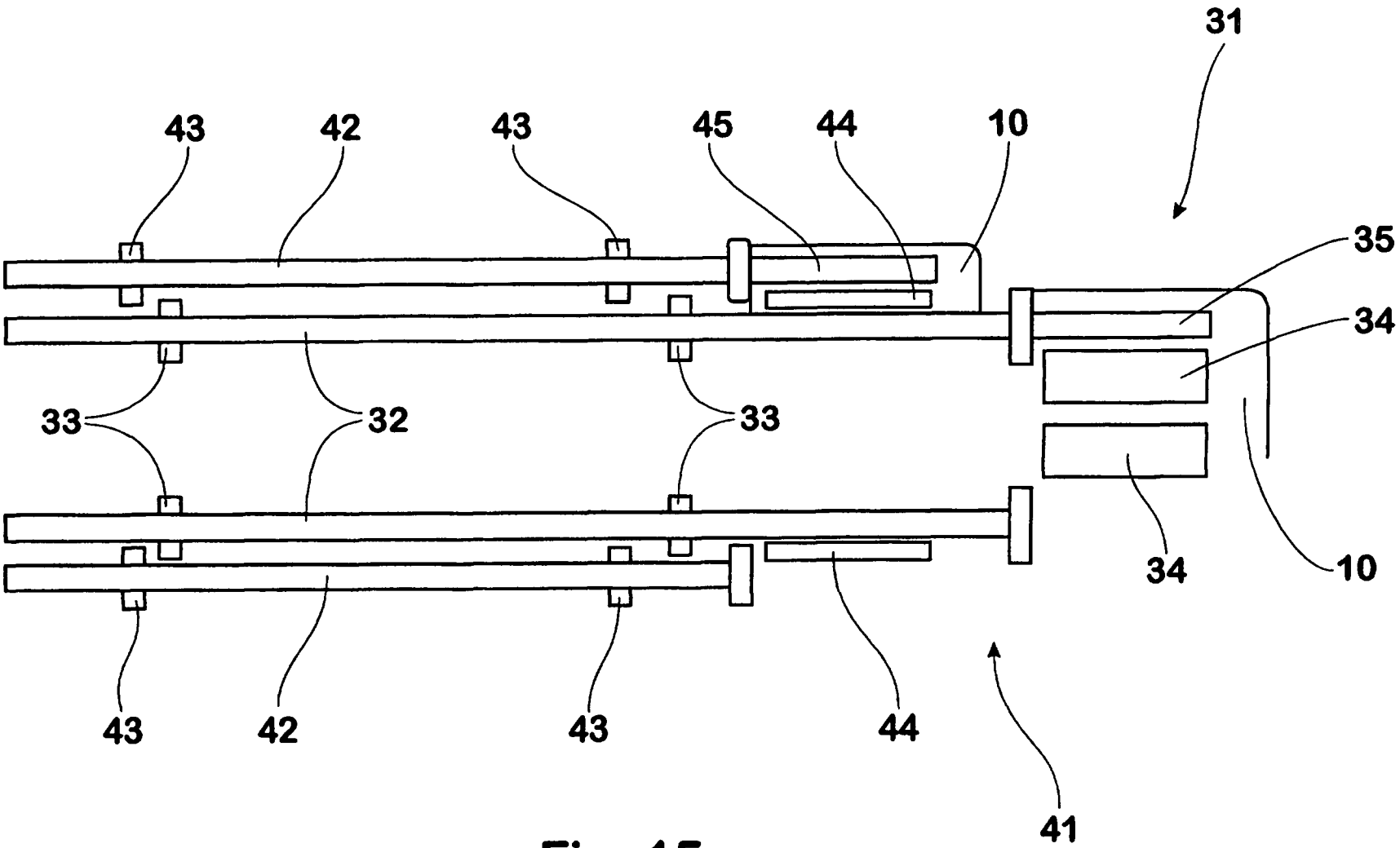
FIG. 15 is a conceptual plan view of the gun of the further embodiment.

In a further embodiment of the present invention, a gun 30 including a concentric arrangement of circumrotating barrels 31, 41 fed by respective belts 38, 48 is illustrated in FIGS. 14 and 15. These drawings are schematic only and serve to illustrate the concept, which employs an inner set of barrels 31 and a concentric outer set of barrels 41. With reference to FIG. 14, each of the sleeves 37, 47 of this embodiment includes three cartridges 36, 46, wherein the propellant may be selectively electronically ignited by a firing mechanism (not shown) for sequentially propelling the projectiles from the muzzle of a respective barrel 32, 42. In this embodiment, a total of 20 barrels is provided with a projected rate of fire of 6000 rpm. Accordingly, if all 3 cartridges in each of 8 barrels are available for discharge, a maximum rate of fire of up to 144,000 rpm is possible.

FIG. 15 is a conceptual plan view of the gun of the second embodiment, wherein the barrels 32, 42 are supported by annular rings 33, 43. The breech block 10 in each case is associated with cylinders 34, 44 having cradles 35, 45 for receiving the belts 38, 48 carrying (or incorporating) sleeves 37, 47 as per FIG. 14.

A person skilled in the art will be able to understand the concept of a gun with concentric barrels depicted in FIGS. 14 and 15 employing the teachings herein.

The invention claimed is:

1. A belt-fed machine gun for firing a multiplicity of cartridges encased in sleeves and linked to form a belt, said belt-fed machine gun including:

a plurality of substantially parallel barrels mounted for circumrotation;

a plurality of cradles for supporting the cartridges encased in the sleeves, said cradles being mounted for circumrotation with said plurality of substantially parallel barrels wherein a number of the plurality of cradles in an operative position are aligned coaxially with corresponding barrels;

a housing and a breechblock which cooperates with the cradles during circumrotation to urge the cartridges and the sleeves towards the barrels, wherein said housing and said number of cradles in the operative position engage sleeves encasing cartridges to form chambers with said breechblock, and said breechblock further includes a guide to engage with the cartridges or sleeves for urging said cartridges and sleeves towards said corresponding barrels; and a firing mechanism for initiating a propellant charge in one or more of the cartridges supported by the cradles in the operative position.

2. The belt-fed machine gun of claim 1 wherein the guide includes a camming surface to urge the cartridges and sleeves into sealable engagement with the corresponding barrels.

3. The belt-fed machine gun of claim 2 wherein the guide is in the form of a cam which urges the cartridges into salable engagement with the barrel for firing.

4. The belt-fed machine gun of claim 1 wherein the breechblock and the housing are formed as an integral member.

5. The belt-fed machine gun of claim 1 wherein an inner wall of the housing is shaped such that it tightly engages the sleeves to form a sealed chamber at a firing station.

6. The belt-fed machine gun of claim 1 wherein the chambers are formed by the housing engaging the sleeves and the linkages therebetween.

7. The belt-fed machine gun of claim 1 wherein the cradles are formed as channels in the external surface of a cylinder.

8. The belt-fed machine gun of claim 1 wherein the cradles are shaped to conform to the outer profile of the sleeves.

9. The belt-fed machine gun of claim 1 wherein the barrels are mounted on a frame for circumrotation about an axis of rotation.

10. The belt-fed machine gun of claim 1 wherein the barrels mounted for circumrotation are in a form of bores in a cylinder or tubular section.

11. The belt-fed machine gun of claim 1 wherein the cradles circumrotate about a common axis with the barrels.

12. The belt-fed machine gun of claim 1 wherein each barrel has a corresponding cradle with which it is coaxially aligned such that the barrels and cradles may circumrotate in unison.

13. The belt-fed machine gun of claim 1 wherein the sleeves include a frustro-conical nose that engages a corresponding tapered portion on the adjacent barrels.

14. The belt-fed machine gun of claim 1 wherein the sleeves are constructed from a material having thermal insulating properties.

15. The belt-fed machine gun of claim 1 wherein the sleeves act as heat sinks to remove excess heat from the breechblock and housing of said gun.

16. The belt-fed machine gun of claim 1 wherein the belt acts as a thermal insulation so that the heat is removed from the chamber with the sleeve and the cartridge.

17. The belt-fed machine gun of claim 1 wherein each of the sleeves include an internal bore corresponding to a tapered portion of each cartridge, said cartridges each including a projectile, a propellent and a detonator enclosed in a casing.

18. The belt-fed machine gun of claim 1 wherein the sleeve extends along length of said cartridge.

19. The belt-fed machine gun of claim 1 wherein the sleeve encases said cartridge.

20. The belt-fed machine gun of claim 1 wherein the cartridge extends beyond the end of said sleeve and said cartridge having a follower for engagement with the guide on said breechblock to provide a caming action which urges the sleeve and the cartridge into sealable engagement with a barrel.

21. The belt-fed machine gun of claim 1 wherein the cartridge includes a tubular shell having a bore a plurality of projectiles axially disposed within the shell for operative sealing engagement with the bore of the shell and discrete propellent charges for propelling the respective projectiles.

22. The belt-fed machine gun of claim 1 wherein each cartridge contains a coolant for release after the projectile has been fired.

23. The belt-fed machine gun of claim 22 wherein the propellant is detonated and the bullet fired at a first firing station and, at a second firing station, a second initiation releases the coolant from the cartridge.

24. The belt-fed machine gun of claim 22 wherein the coolant is a compressed gas.

25. The belt-fed machine gun of claim 1 wherein drive for circunirotation of the barrels and the cradles is provided by an electric motor.

26. The belt-fed machine gun of claim 25 wherein the motor directly drives the barrels and the cradles.

27. The belt-fed machine gun of claim 25 wherein the motor engages the barrels and cradles through a drive mechanism said mechanism including gears selected to provide a desired speed of rotation and torque.

28. The belt-fed machine gun of claim 27 wherein the drive mechanism is adapted to provide selectable speeds of rotation such that the rate of fire of the gun is selectively variable.

29. The belt-fed machine gun of claim 1 wherein the firing mechanism for initiating the propellent includes electrical actuation.

30. The belt fed machine gun of claim 1 wherein the plurality of substantially parallel barrels include first and second sets of barrels arranged concentrically with respect to one another, said first and second sets of barrels having respective cradles and cooperating breech blocks.

31. The belt fed machine gun of claim 30 further including a drive for circumrotation of the sets of barrels.

32. The belt fed machine gun of claim 31 wherein the drive is arranged for circumrotation of the first set of barrels in a direction counter to that of the second set of barrels.

33. The belt fed machine gun of claim 30 wherein the first set of barrels are formed as bores in a cylinder and the second set of barrels are formed as bores in a tubular section.

34. The belt fed machine gun of claim 30 wherein the first set of barrels is configured for firing different cartridges to that of the second barrel set.

* * * * *